United States Patent [19]

Ueno et al.

[11] 4,247,088

[45] Jan. 27, 1981

[54] MUD GUN

[75] Inventors: Masayuki Ueno; Fumiaki Sano, both of Yokohama; Makoto Sagae, Tokyo; Tateo Kayama, Toride, all of Japan

[73] Assignee: Ishikawajima-Harima Jukogyo Kabushiki Kaisha, Tokyo, Japan

[21] Appl. No.: 942,385

[22] Filed: Oct. 5, 1978

[51] Int. Cl.[3] ..... C21B 7/12

[52] U.S. Cl. ..... 266/273

[58] Field of Search ..... 266/271, 272, 273

[56] References Cited

U.S. PATENT DOCUMENTS

| | | | |
|---|---|---|---|
| 3,516,651 | 6/1970 | Honda et al. | 266/271 X |
| 3,709,477 | 1/1973 | Baumer et al. | 266/273 |
| 3,765,663 | 10/1973 | Legille et al. | 266/273 |
| 3,828,974 | 8/1974 | Tenner | 266/272 X |
| 3,973,761 | 8/1976 | Pelletier et al. | 266/272 |
| 4,033,565 | 7/1977 | Jeno et al. | 266/273 |

FOREIGN PATENT DOCUMENTS

| | | | |
|---|---|---|---|
| 367957 | 1/1923 | Fed. Rep. of Germany | 266/273 |
| 1325549 | 3/1963 | France | 266/273 |

*Primary Examiner*—F. C. Edmundson

*Attorney, Agent, or Firm*—Scrivener, Parker, Scrivener and Clarke

[57] ABSTRACT

A mud gun for closing a tap hole of a vertical furnace, especially a blast furnace, is provided with a novel mechanism for traversing the gun barrel and pressing the muzzle of the barrel against the tap hole under high pressure.

8 Claims, 15 Drawing Figures

MUD GUN

SUMMARY OF THE INVENTION

Figure 1:
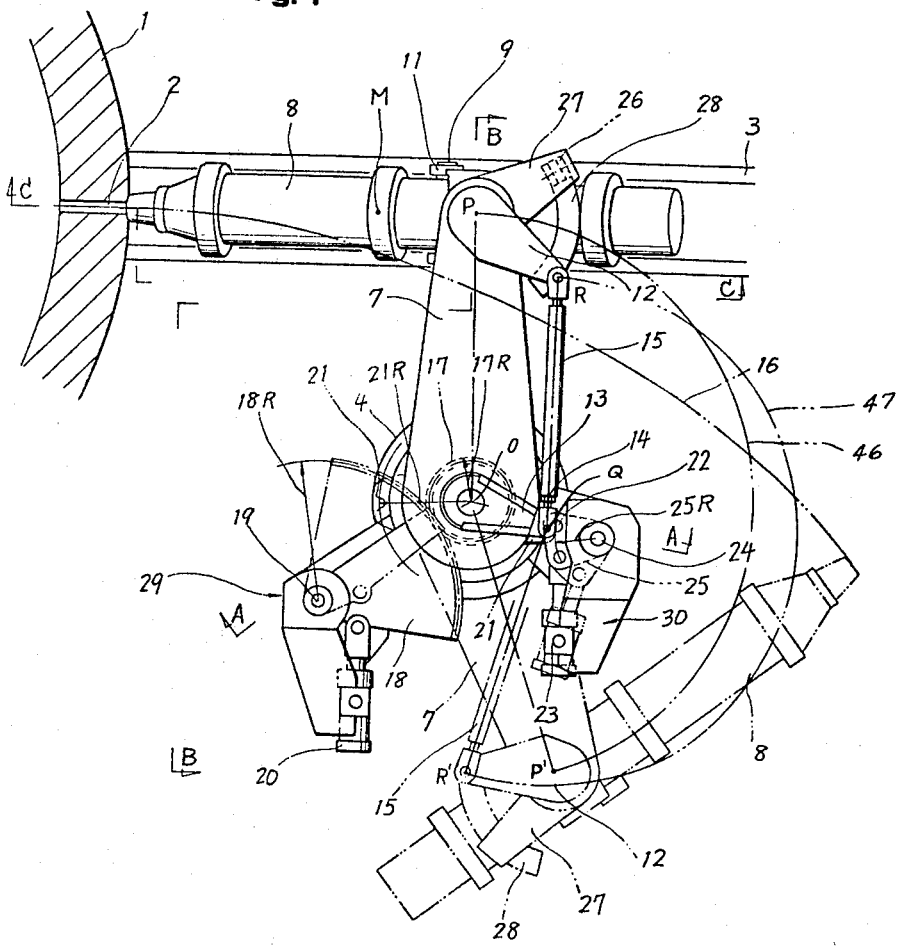
FIG. 1 is a schematic top view of a first embodiment of a mud gun in accordance with the present invention.
Figure 2:
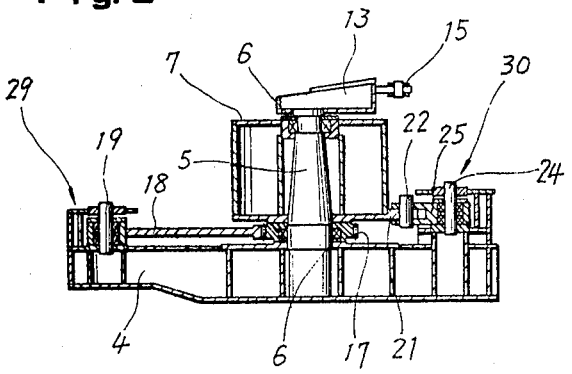
FIG. 2 is a sectional view taken along the line A—A of FIG. 1.

The invention provides simple and compact means for traversing the barrel of a mud gun which closes the taphole of a blast furnace or the like, in which the traversing of the barrel from an inoperative position to an operative position at the taphole is immediately followed by the operation of means for pressing the barrel against the taphole, and high pressure of the barrel against the taphole is maintained without the necessity or use of clamping means. The means provided for transversing the barrel produces high torque with control of the traversing speed.

Referring to FIGS. 1 to 4, a center post 5 is erected on a mount 4 which is spaced apart from a taphole 2 and a molten iron runway 3 of a blast furnace or a shaft 1 by a suitable distance. The rear end of a traversing arm 7 is mounted through bearings 6 on the center post 5 for rotation in a horizontal plane. Trunnions or pins 9 which extend from the barrel 8 between its ends are pivoted to the arms of a supporting member 11 so that the center of gravity M of the barrel 8 may be located in the forward half thereof and the barrel 8 may be tilted about the pins 9. The supporting member 11 has a vertical barrel supporting shaft 10 which is rotatably supported by the traversing arm 7 at the leading end thereof over the runway 3.

A first bracket 12 is formed integral with and extends from the top of the barrel supporting shaft 10 and a second bracket 13 is securely attached to the upper end of the center post 5. The free ends of the first and second brackets 12 and 13 are interconnected by a control rod 15 whose length is adjustable buy a screw 14. Thus the first and second brackets 12 and 13, the control rod 15 and the traversing arm 7 form a linkage so that the muzzle of the barrel 8 may traverse along a path 16 indicated by the two-dot chain lines in FIG. 1.

A traversing gear or a girth gear 17 is securely attached to the center post 5 below the traversing arm 7 and is in mesh with the sector gear 18 which is caused to swing about a pin 19 by a traversing hydraulic cylinder 20. The sector gear 18 and the hydraulic cylinder 20 constitute a device 29 for driving the traversing gear 17.

A concave partial gear 21 is extended from the bottom plate of the traversing arm 7. The tooth profile of the partial gear 21 is that of a pin gearing. A pin 22 for engagement with the partial gear 21 is securely attached to a pin gear 25 which is caused to rotate by means of a pressing cylinder 23 about a pin 24 extended from the mount 4. Thus the partial gear 21, the pin gear 25 and the hydraulic cylinder 23 constitute a device 30 for pressing the barrel 8 against the taphope 2.

Figure 3:
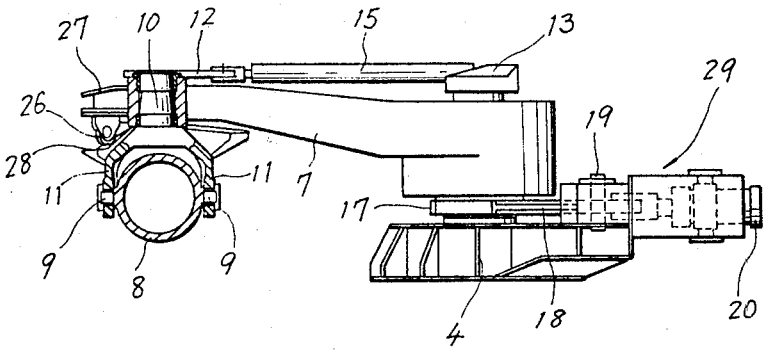
FIG. 3 is a sectional view thereof taken along the line B—B of FIG. 1.

A guide roller supporting bracket 27 is extended from the front end of the traversing arm 7 and carries a peripherally ball-shaped guide roller 26 which rides on an inclined plate 28 mounted on the barrel 8 as best shown in FIG. 3.

In FIGS. 1 to 4, X denotes the angle of tilting of the barrel 8; 17R, the radius of the traversing gear 17; 18R, the radius of the sector gear 18; 21R, the radius of the partial gear 21; and 25R, the radius of the pin gear 25.

The angle of the sector gear 18 is such that the barrel 8 may traverse from the operative position indicated by the full line to the retracted or inoperative position indicated by the two-dot chain line in FIG. 1 or vice versa. The partial gear 21 (more particularly its teeth) and the pin gear 25 (more particularly its pin 22) are so positioned that when the barrel 8 is traversed close to its operative position, the partial gear 21 and the pin 22 of the pin gear 25 may automatically engage with each other.

Next the mode of operation for closing the taphole 2 will be described. The barrel 8 is initially retracted to the inoperative position indicated by the imaginary line in FIG. 1. First the traversing cylinder 20 is retracted so that the sector gear 18 is caused to swing in the clockwise direction and consequently the traversing gear 17 and hence the traversing arm 7 are rotated in the counterclockwise direction. Thus the barrel 8 is traversed toward the iron runway 3. In this case, the linkage consisting of the first and second brackets 12 and 13 and the control rod 15 controls the traversing of the barrel 8 in such a way that the muzzle may follow the path 16 as described elsewhere.

When the muzzle of the barrel 8 is brought closer to the taphole 2, the partial gear 21 and the pin 22 of the pin gear 25 automatically intermesh. Immediately thereafter the pressing cylinder 23 is actuated so as to extend its piston so that the barrel 8 is pressed against the taphole 2 under a considerably high pressure of the order of about 30 tons, which is required for charging mud. The barrel 8 may be pressed against the taphole 2 as long as required in the manner described above.

Immediately before the barrel 8 is pressed against the taphole 2, the inclined plate 28 on the barrel 8 comes into contact with the guide roller 26 so that the barrel 8 is tilted or depressed more precisely at an optimum angle X of depression relative to the taphole 2. (In general the angle of depression of the barrel 8 is greater than the angle of inclination of the taphole 2). As a result, the muzzle of the barrel 8 will be kept from contact with the molten iron for a long time whereby melting of the barrel 8 may be avoided.

The radius 17R of the traversing gear 17 is made smaller than the radius 18R of the sector gear 18 so that the traversing cylinder 20 may be shortened. The radius 21R of the partial gear 21 is made greater than the radius 25R of the pin gear 25 so that the pressing cylinder 23 may be made compact in size and the barrel may be pressed against the taphole 3 under a greater force.

When the barrel 8 is retracted to the inoperative position after mud has been charged to close the taphole 2, the pressing hydraulic cylinder 23 is de-energized first and then the traversing hydraulic cylinder 20 is extended; alternatively, the pressing and traversing cylinders are simultaneously operated reversedly of each other, i.e., the pressing cylinder 23 is retracted while the traversing cylinder 20 is extended. The partial gear 21 and the pin gear 25 are automatically released from each other and the pin gear 25 remains in the released position. Therefore when the barrel 8 is traversed again to the operative position the pin gear 25 may automatically and smoothly engage with the partial gear 21.

Figure 5:
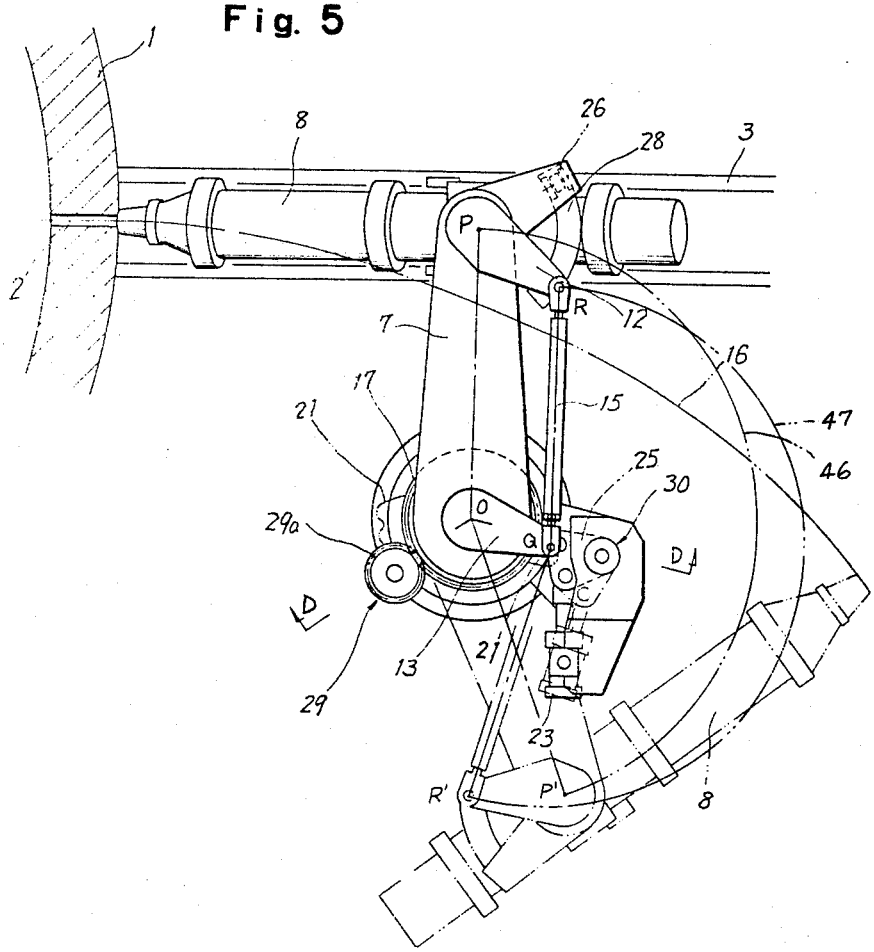
FIG. 5 is a top view of a second embodiment of a mud gun in accordance with the present invention.
Figure 6:
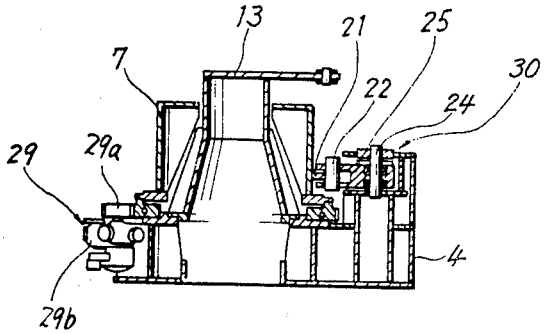
FIG. 6 is a sectional view thereof taken along the line D—D of FIG. 5.

The second embodiment shown in FIGS. 5 and 6 is substantially similar in construction to the first embodiment except that instead of the sector gear 18 and the traversing hydraulic cylinder 20, a driving pinion 29*a* and an actuator 29*b* are used.

In both the first and second embodiments, the arrangement of the partial gear 21 and the pin gear 25 may be reversed. Instead of them any suitable gears such as spur gears may be used. A roller pin may be used. Furthermore relative positions between the partial gear 21, the pin gear and the traversing device 29 may be suitably selected as needs demand.

Referring to FIGS. 7 to 10, the traversing gear 17 is securely fitted over the center post 5 under the traversing arm 7 and is in mesh with the sector gear 18 which is caused to swing about the pin 19 by a hydraulic cylinder 31. As best shown in FIG. 16, a partial pin gear 36 with one pin 22 is securely attached to the bottom plate at the rear end of the traversing arm 7. A mating gear 32 with only two teeth for engagement with the pin 22 of the gear 36 is formed integral with the sector gear 18 for rotation about the pin 19 in unison therewith.

Referring to FIG. 16, as is the case of the first or second embodiment, the angle of the sector gear 18 is such that the barrel 8 may traverse from the operative position to the retracted or inoperative position or vice versa. And the first and second pin gears 36 and 32 are so positioned with respect to each other that when the muzzle of the barrel 8 is brought closer to the taphole 2; that is, when the segment gear 18 is disengaged from the traversing gear 17, the first and second pin gears 36 and 32 may automatically engage with each other and remain in mesh.

Referring back to FIGS. 13–16, when the hydraulic cylinder 31 is extended to rotate the sector gear 18 in the clockwise direction about the pin 19, the traversing gear 17 and hence the traversing arm 7 are caused to rotate in the counterclockwise direction so that the barrel 8 is traversed toward the taphole 2. As the muzzle of the barrel 8 is brought very close to the taphole 2, the sector gear 18 is disengaged from the traversing gear 17 and the first and second pin gears 36 and 32 engage with each other as best shown in FIG. 16. When the hydraulic cylinder 31 is further extended, the barrel 8 is pressed against the taphole 2 under a high pressure of the order of 30 tons and remains pressed against the taphole for a desired time.

The radius 17R of the traversing gear 17 is made smaller than the radius 18R of the sector gear and the radius 36R of the first pin gear 36 is made greater than the radius 32R of the second pin gear. Therefore with the hydraulic cylinder 31 which is relative small in size, the traversing angle is increased (through more than 180°) and the pressure with which the muzzle of the barrel 8 is pressed against the taphole may be considerably increased.

Figure 13:
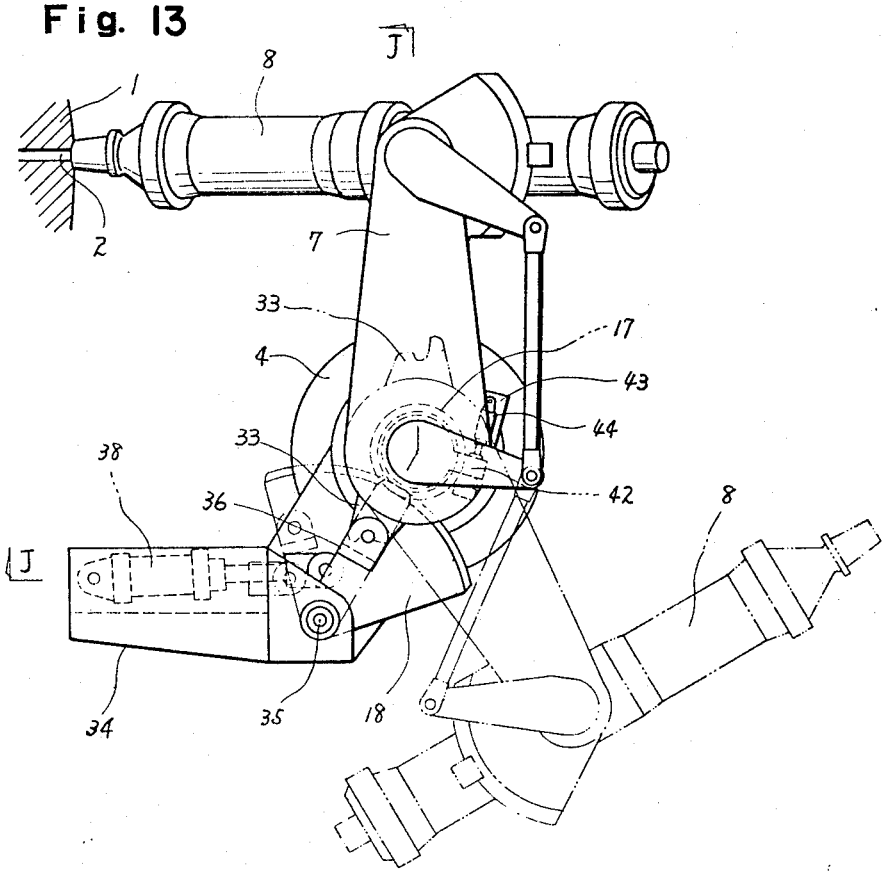
FIG. 13 is a top view of a fifth embodiment of the present invention.

To retract the barrel 8 to the inoperative position indicated by the imaginary lines in FIG. 13, the hydraulic cylinder 31 is retracted. That is, when the hydraulic cylinder 31 is retracted to rotate the second pin gear 32 in the counterclockwise direction, the traversing arm 7 and hence the barrel 8 are caused to traverse in the clockwise direction. After the transverse of the traversing arm 7 and the barrel 8 through a predetermined angle, the second pin gear 32 is disengaged from the pin 22 of the first pin gear 36 and at the same time the sector gear 18 is automatically engaged with the traversing gear 17. Thus, the traversing arm 7 and the barrel 8 are continuously traversed to the inoperative position.

As described above, the third embodiment is advantageous in that only one hydraulic cylinder is used for not only traversing the barrel 8 but also pressing it against the taphole after depressing it at an optimum angle.

Figure 11:
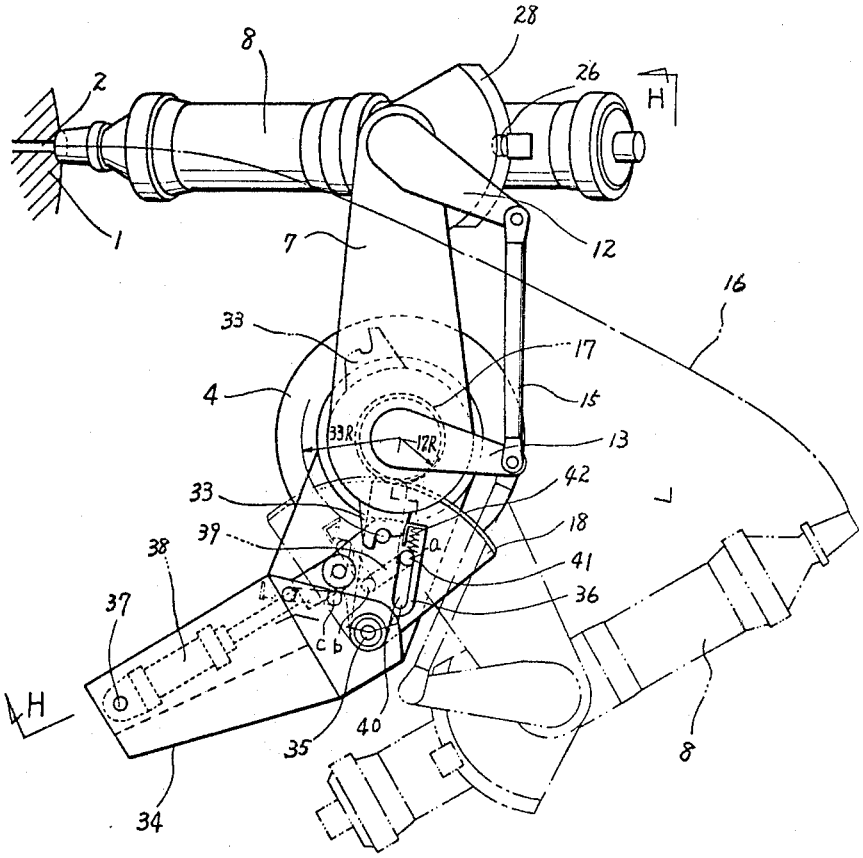
FIG. 11 is a top view of a fourth embodiment of a mud gun in accordance with the present invention.
Figure 12:
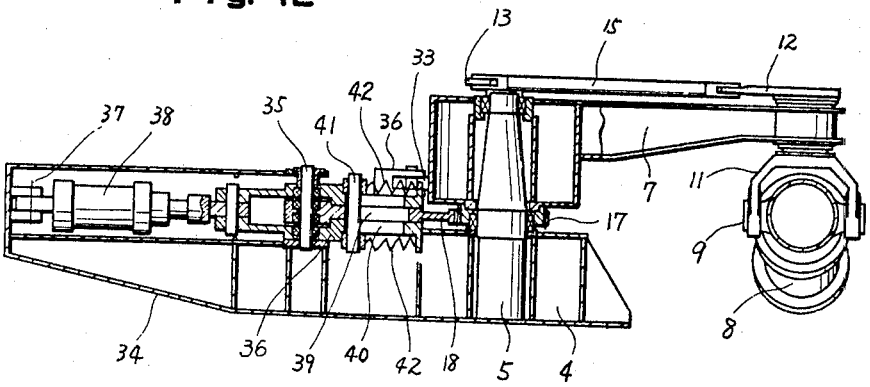
FIG. 12 is a sectional view thereof taken along the line H—H of FIG. 11.

Referring to FIGS. 11 and 12, in the fourth embodiment in addition to the traversing gear 17, a pin gear arm 33 with two teeth and a radius of 33R is securely fitted over the base of the traversing arm 7 for rotation about the center post 5 in unison with the traversing arm 7.

A driving stand 34 is mounted on the mount 4 backwardly of the barrel 8 in the retracted position indicated by the imaginary lines in FIG. 17. The sector gear 18 and a pin gear 36 having one pin for engagement with the pin gear arm 33 are mounted with a pin 35 for rotation thereabout. The base of a hydraulic power cylinder 38 is pivoted with a pin 37 to the driving stand 34, and the leading end of a piston rod thereof is connected to the pin gear 36.

The sector gear 18 and the pin gear 36 are respectively formed with elongated slots 39 and 40, and a connecting pin 41 is fitted into these elongated slots 39 and 40 and is biased by springs 42. These slots 39 and 40, the connecting pin 41 and the bias springs 42 constitute a device or means for absorbing the difference in rotation between the segment and pin gears 18 and 36. When the sector gear 18 and the traversing gear 17 are in mesh with each other and when the hydraulic cylinder 38 is extended, there arises the difference in rotational speed between the segment gear 18 and the pin gear arm 33 because the pitch circle of the sector gear 18 is smaller than that of the pin gear arm 33, so that they cannot be rotated simultaneously. However with the rotation difference absorbing device described above, the difference in rotational speed between them may be eliminated so that only one driving cylinder 38 suffices to traverse the barrel 8 and press it against the taphole 2.

To retract the barrel 8 from the operative position indicated by the full lines in FIG. 11 to the inoperative position indicated by the imaginary lines, the driving cylinder 38 is retracted so that the pin gear 36 is caused to rotate about the pin 35. However, the connecting pin 41 is displaced from the position a to the position b along the elongated slot 39 of the sector gear 18 so that the sector gear 18 only follows the traversing gear 17 and does not have driving force. As a result, the pin gear arm 33 which is in mesh with the pin gear 36 causes the barrel 8 to traverse. When the connecting pin 41 reaches the position b, the pin gear 36 and the pin gear arm 33 are disengaged from each other and the rotation of the pin gear 36 is transmitted through the connecting pin 41 to the segment gear 18 so that the latter is rotated in unison with the pin gear 36 and consequently the traversing gear 17 in mesh with the sector gear 18 is rotated in the clockwise direction so as to traverse the barrel 8 to the retracted position.

To traverse the barrel 8 from the retracted position to the operative position, the driving cylinder 38 is extended so that the pin gear 36 is rotated and the rotation of the pin gear 36 is transmitted through the connecting rod 41 to the sector gear 18 in mesh with the traversing gear 17. As a result the barrel 8 is traversed toward the operative position. During this traversing movement, the connecting pin 41 is displaced from the position c to the position b and the pin gear 36 engages with the pin gear arm 33 so that the rotation of the pin gear 36 is directly transmitted through the pin gear arm 33 to the barrel 8. Since the radius 33R of the pin gear arm 33 is greater than that 17R of the traversing gear, the muzzle of the barrel 8 is pressed against the taphole 2 under high pressure. During the pressing the connecting pin 41 is permitted to displace from the position b toward the position a through the elongated slot 39 so that no rotational force is transmitted to the sector gear 18.

A roller pin may be used as the connecting pin 14 in order to smooth the driving.

Figure 14:
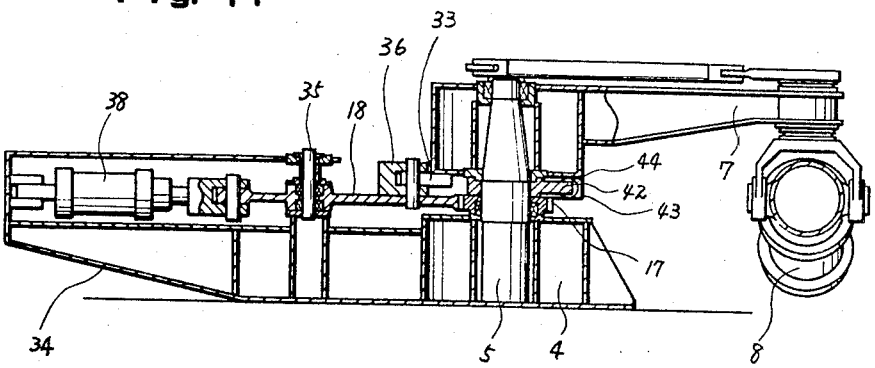
FIG. 14 is a sectional view thereof taken along the line J—J of FIG. 13.

The fifth embodiment shown in FIGS. 13 and 14 is substantially similar in construction to the fourth embodiment described above with reference to FIGS. 11 and 12 except (a) that the pin gear 36 is securely attached to the sector gear 18 for rotation in unison therewith and (b) that a rotation difference absorbing device is provided for interrupting the transmission of the power from the sector gear 18 to the traversing gear even though they are in mesh immediately after the engagement of the pin gear 36 with the pin gear arm 33 which produces a great rotation moment for pressing the muzzle of the barrel 8 against the taphole 2. The rotation difference absorbing device comprises a hydraulic cylinder 44, a control arm 42 and a support 43. The base of the hydraulic cylinder 44 is pivoted to the support 43 while the leading end of a piston rod thereof is connected to one end of the control arm 42 the other end of which is securely connected to the traversing gear 17.

When the sector gear 18 is driven to rotate the traversing gear 17, thereby traversing the barrel 8, the hydraulic cylinder 44 is extended so as to hold through the control arm 42 the traversing gear 17 stationary with respect to the traversing arm 7, whereby the pin gear 36 may engage with the pin gear arm 33 at an optimum position. Immediately after the pin gear 36 has engaged with the pin gear arm 33 the hydraulic cylinder 44 is retracted so that the traversing gear 17 may be free to rotate with respect to the traversing arm 7. As a result, the power is now directly transmitted from the pin gear 36 through the pin gear arm 33 to the traversing arm 7 so that the barrel 8 may be pressed against the taphole 2 under a high pressure.

Figure 15:
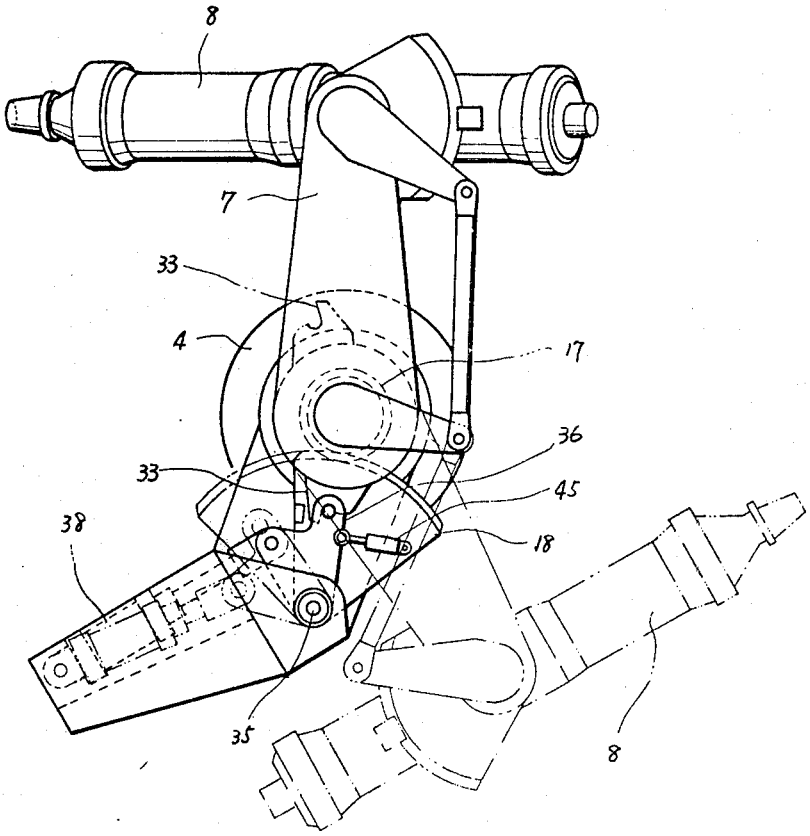
FIG. 15 is a schematic top view of a sixth embodiment of a mud gun in accordance with the present invention.

The sixth embodiment shown in FIG. 15 is substantially similar in construction to the fifth embodiment except the arrangement of the rotation difference absorbing device comprising a hydraulic cylinder 45. The base of the hydraulic cylinder 45 is pivoted to the sector gear 18 while the leading end of its piston rod is pivoted to the pin gear 36.

When the driving cylinder 38 is retracted, both the sector gear 18 and the pin gear 36 are driven in unison with each other because the hydraulic cylinder 45 is locked, and at the instant when the pin gear 36 engages with the pin gear arm 33, the hydraulic cylinder 45 is set free so that the sector gear 18 remains stationary while the rotation of the pin gear 36 is further continued. Thus the muzzle of the barrel 8 can be pressed against the taphole 2 of the blast furnace 1 under high pressure.

As described above, the rotation difference absorbing device causes the barrel 8 to press against the taphole 2 under high pressure while the segment gear 18 is in mesh with the traversing gear 17. In other words, with only one traversing power cylinder the gun barrel 8 may be traversed and pressed against the taphole 2 under high pressure.

In the operation of the various embodiments of the invention the apparatus for aligning the gun as it approaches the taphole is actuated to function simultaneously with the traverse of the gun. As illustrated particularly in FIGS. 1, 5 and 7 the first and second brackets 12 and 13, the control rod 15 and the traversing arm 7 form a linkage OPRQO, the points O and Q being pivots. When OP (the traversing arm 7) is swung by the traversing means such as the sector gear 18 and the traversing cylinder 20, the points P and R are pivoted about the pivots O and Q, respectively, to draw the circular arc paths 46 ($\widehat{P'P}$) and 47 ($\widehat{R'R}$), respectively.

Figure 7:
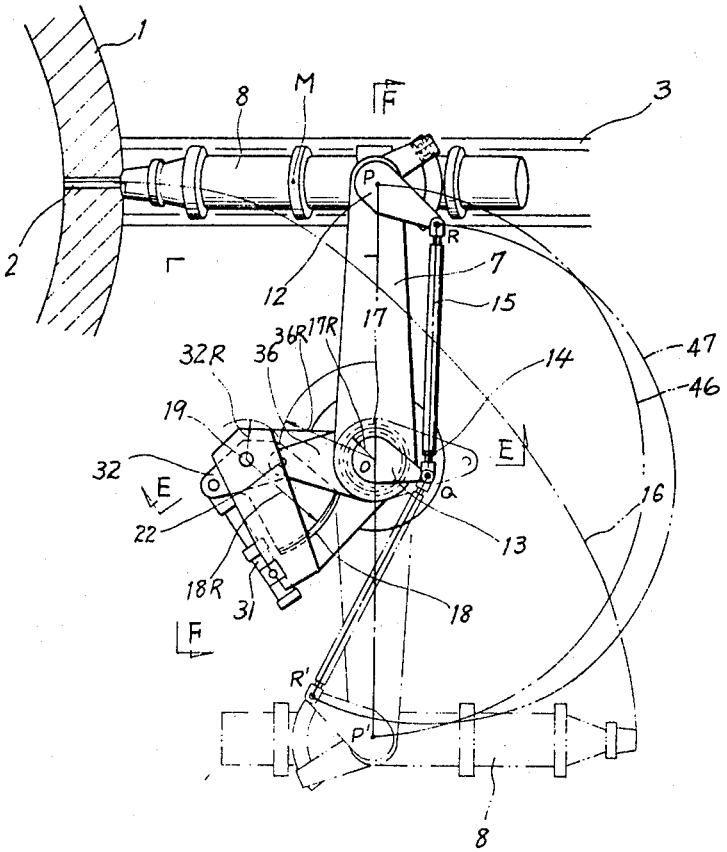
FIG. 7 is a top view of a third embodiment of a mud gun in accordance with the present invention.
Figure 8:
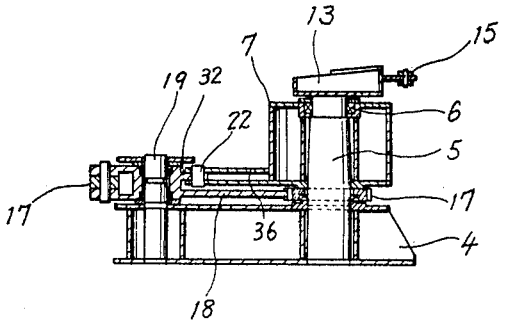
FIG. 8 is a sectional view thereof taken along the line E—E of FIG. 7.
Figure 9:
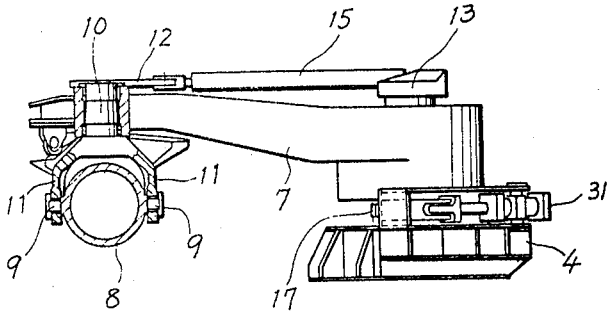
FIG. 9 is a view, partly in section, thereof looking in the direction indicated by the arrows F—F of FIG. 7.
Figure 10:
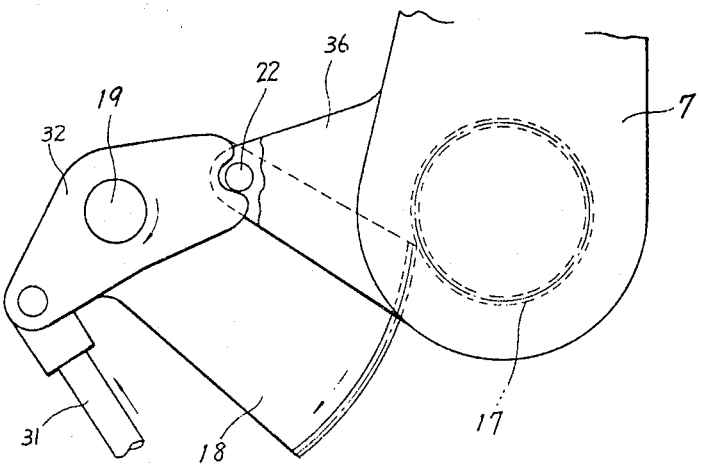
FIG. 10 is a fragmentary view, on enlarged scale, of FIG. 7 used for the explanation of traversing a gun barrel and pressing it against the taphole.

In FIGS. 1, 5 and 7 the movement of the barrel 8 and the traversing arm 7 to the operative position is indicated by the full line and the movement to the inoperative position by the imaginary line. The points P' and R' correspond to the point P and R.

Figure 4:
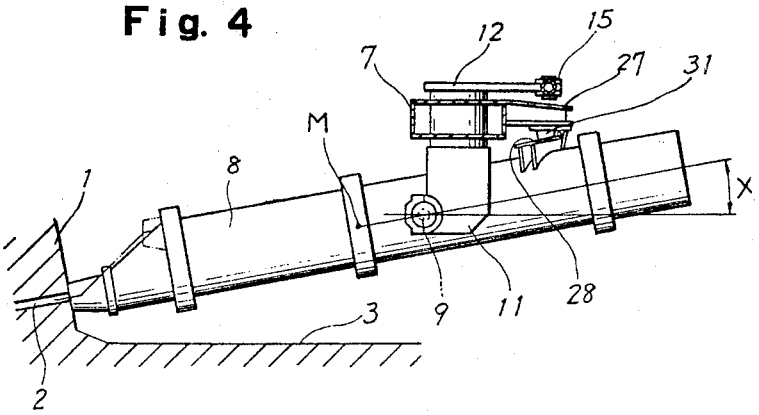
FIG. 4 is a view looking in the direction indicated by the arrow C of FIG. 1.

As also shown in FIGS. 1, 5 and 11 when the mud gun is traversed from the inoperative position to the operative position, the muzzle of the barrel 8 draws the curve 16. As is clear from the drawings, this curve is not a circular arc and is substantially tangent to the centerline of the taphole 2 in the vicinity of the taphole 2. That is, the muzzle of the barrel is swung to enter above the runway 3 from a distance, and then is substantially rectilinearly introduced toward the surface of the taphole 2. At this time, the barrel is tilted downwardly so that the muzzle thereof may be pressed perpendicularly against the surface of the taphole because the taphole 2 is generally slightly tilted upwardly. This tilting mechanism is shown in FIGS. 3 and 4 and is described above.

What is claimed is:

1. A mud gun comprising a fixed center post, a traversing arm rotatably supported at a first end thereof on the center post, a gun barrel mounted on the other end of the traversing arm and having a muzzle, a traversing gear securely attached to the first end of the traversing arm and rotatably mounted in coaxial relationship on said center post, a gear mechanism engageable with said traversing gear and operable to traverse said traversing arm through about 180°, and a pressing gear mechanism attached to said other end of the traversing arm and including a gear mounted on the center post, the pressing gear mechanism being adapted to begin tooth-engagement immediately before the muzzle of said gun barrel is brought in contact with the taphole of a blast furnace, the radius of said traversing gear being shorter than the radius of said pressing gear mechanism relative to the axis of the center post.

2. A mud gun as set forth in claim 1 including a partial gear securely attached to said the other end of the traversing arm in a coaxial relationship with said traversing gear, a sector gear engageable with said traversing gear and driven by a traversing hydraulic cylinder and a pressing gear engageable with said partial gear and driven by a pressing hydraulic cylinder.

3. A mud gun as set forth in claim 2 wherein said traversing gear is driven through a pinion by a pinion driving actuator.

4. A mud gun as set forth in claim 1 including a partial gear securely attached to said the other end of the traversing arm in a coaxial relationship with said traversing gear, a sector gear and a pressing gear which are disposed rotatably in unison so that the engagement of the pressing gear with the partial gear may immediately follow the engagement of the sector gear with the traversing gear and a hydraulic cylinder for simultaneously driving said sector gear and said pressing gear.

5. A mud gun as set forth in claim 1 including a partial gear arm securely attached to said the other end of the traversing arm in a coaxial relationship with said traversing gear, a sector gear and a pressing gear which are rotatable about a common axis by a driving cylinder to engage with said traversing gear and said partial gear arm respectively, and a rotation difference absorption device for absorbing the difference in rotation between said sector gear and said pressing gear when they are driven by said driving cylinder.

6. A mud gun as set forth in claim 5 wherein said sector gear and said pressing gear are formed with elongated slots fitted with a connecting pin which is loaded with biasing springs.

7. A mud gun as set forth in claim 5 including a hydraulic cylinder one end of which is pivoted to said traversing arm while the other end is securely attached to a control arm which in turn is securely attached to said traversing gear.

8. A mud gun as set forth in claim 5 wherein a hydraulic cylinder is interposed between said sector gear and said pressing gear.

* * * * *